US005092384A

United States Patent [19]

Easley

[11] Patent Number: 5,092,384

[45] Date of Patent: Mar. 3, 1992

[54] CURTAIN SYSTEM AND METHOD

[75] Inventor: Madlyn Easley, West Hartford, Conn.

[73] Assignee: Intrascapes, Ltd., West Hartford, Conn.

[21] Appl. No.: 590,141

[22] Filed: Sep. 28, 1990

Related U.S. Application Data

[63] Continuation-in-part of Ser. No. 3,547, Jan. 1, 1987, abandoned.

[51] Int. Cl.[5] ..... A47H 1/00

[52] U.S. Cl. ..... 160/126; 160/38

[58] Field of Search ..... 160/38, 39, 330, 348, 160/123, 126, 405

[56] References Cited

U.S. PATENT DOCUMENTS

| | | | |
|---|---|---|---|
| 149,770 | 4/1874 | May . | |
| 238,527 | 3/1881 | Replogle | 160/38 |
| 1,708,107 | 4/1929 | Plotkin . | |
| 1,776,047 | 9/1930 | Shulman . | |
| 1,956,116 | 4/1934 | Carver | 156/16 |
| 2,194,242 | 3/1940 | Kahn | 156/10 |
| 2,310,014 | 2/1943 | Apfel | 160/35 |
| 2,329,462 | 9/1943 | Friedberg | 160/330 |
| 2,352,531 | 6/1944 | Gallo | 160/330 |
| 2,395,335 | 2/1946 | Loeb | 160/124 |
| 2,528,652 | 11/1950 | Gundlach | 160/348 |
| 2,547,697 | 4/1951 | Gallo | 160/330 |
| 2,548,879 | 4/1951 | Druck | 160/330 |
| 2,588,256 | 3/1952 | Lepow | 160/124 |
| 2,620,027 | 12/1952 | Eisenberg | 160/327 |
| 2,815,807 | 12/1957 | Loos | 160/126 |
| 2,910,120 | 9/1959 | Rosen | 160/84 |
| 3,011,174 | 12/1961 | Schaerer | 2/278 |
| 3,151,345 | 10/1964 | Massop | 8/150 |
| 3,160,202 | 12/1964 | Rosen | 160/344 |
| 3,181,594 | 5/1965 | Shapiro | 160/124 |
| 3,321,004 | 5/1967 | Lopes, Jr. | 160/330 |
| 3,322,182 | 5/1967 | Palella | 160/344 |
| 3,399,711 | 9/1968 | Stulac et al. | 160/330 |
| 3,528,477 | 9/1970 | Abraham | 160/84 |
| 3,593,772 | 7/1971 | Abraham | 160/84 |
| 3,733,227 | 5/1973 | Collins, Jr. | 156/196 |
| 3,777,800 | 12/1973 | Susoev | 160/84 R |
| 3,913,655 | 10/1975 | Ogino | 160/84 R |
| 3,952,788 | 4/1976 | Schöler | 160/84 R |
| 3,964,781 | 6/1976 | Fenton | 296/100 |
| 3,999,590 | 12/1976 | Koch | 160/84 R |
| 4,069,857 | 1/1978 | Brookshire | 160/84 R |
| 4,088,170 | 5/1978 | Franklin | 160/84 R |
| 4,397,346 | 8/1983 | Chumbley et al. | 160/84 R |
| 4,399,917 | 8/1983 | Ohman | 160/39 X |
| 4,865,105 | 9/1989 | Peters | 160/38 |
| 4,960,161 | 10/1990 | Easley | 160/126 |

*Primary Examiner*—David M. Purol
*Attorney, Agent, or Firm*—Ira S. Dorman

[57] ABSTRACT

A ready-made cascade and valance curtain set is installed by mounting a valance on a forward curtain rod, and mounting two cascades in spaced relationship on a rearward rod, the cascades being extended over the forward rod to hang in front of the marginal end portions of the valance. Two or more valances may be mounted side-by-side on the forward rod, with an ascot or cravat being draped thereover from the rearward rod so as to hide any gap therebetween.

9 Claims, 2 Drawing Sheets

CURTAIN SYSTEM AND METHOD

CROSS REFERENCE TO RELATED APPLICATION

This application is a continuation-in-part of copending application for Letters Patent, Ser. No. 07/003,547, filed on Jan. 1, 1987 and now abandoned.

BACKGROUND OF THE INVENTION

Frequently, decorated window treatments utilize a valance extending across the top of the window, in combination with laterally spaced jabots, falls, or other cascade components draped along the sides. In some instances, moreover, so-called ascots or cravats are positioned at the center of the window or at spaced locations along the width thereof, for added decorative effects. Such systems are normally custom-made to order, and necessarily fitted to a particular window; they therefore tend to be quite expensive and to require professional installation, and they are not adapted for production in volume.

Accordingly, it is the broad object of the present invention to provide a novel, ready-made valance and cascade curtain set, and a novel system including the same.

It is also an object of the invention to provide such a curtain set and system which are highly attractive, facile to install, and relatively inexpensive to manufacture.

Another object of the invention is to provide a ready-made valance and cascade curtain set which is adapted for sale in packaged condition to the retail market, and for installation by the customer.

A further object is to provide such a curtain set and system in which extension for spanning relatively wide expanses can readily be accomplished, using means that is simple and yet aesthetically enhancing.

A still further object of the invention is to provide a novel method for the decoration of a window or the like, using a ready-made valance and cascade curtain set.

SUMMARY OF THE INVENTION

It has now been found that certain of the foregoing and related objects of the invention are attained by the provision of a curtain system comprising a pair of parallel curtain rods, one mounted behind the other and in substantially the same horizontal plane, a pair of cascades mounted in laterally spaced relationship to one another on the rearward rod, and at least one valance mounted on the forward rod in general alignment with the space between the cascades. Each of the cascades includes a panel, and a laterally extending top pocket. The rearward rod is received through the pockets of the cascades, with the cascades being draped therefrom over the forward rod, to hang in front of the valance in overlapped relationship to lateral marginal portions thereof.

The valance will desirably be of straight configuration, presenting substantially parallel upper and lower rectilinear edges in the mounted condition, and preferably it will be of tubular form so as to define a passage for receipt of the mounting rod. In certain advantageous embodiments of the system, at least one additional valance will be mounted on the forward rod with the adjacent marginal portions of the two valances proximate one another. Such a system will desirably also include at least one ascot component, comprised of a panel and a laterally extending top pocket, mounted on the rearward rod in the space between the cascades and centrally aligned behind the valances; the ascot component will be draped over the forward rod to hang in overlapped relationship to the proximate marginal portions of the valances.

Other objects of the invention are attained by the provision of a ready-made cascade and valance curtain set comprised of the components herein described. Still other objects are attained by the provision of a method for the decoration of a window or the like, utilizing such a curtain set.

In carrying out the method in its broader aspects, one rod is inserted through the pockets of the cascades, so as to dispose them in laterally spaced relationship to one another thereon, and the valance is mounted upon another rod. The rods are secured to supporting structure, with the "one" rod disposed behind the "another" rod and in substantially the same horizontal plane. The cascade panels are then extended forwardly over the "another" rod so as to hang in front of the valance in overlapped relationship, as described.

In those instances in which the curtain set additionally includes at least a second valance and at least one ascot component, the "one" rod will be inserted through the pocket of the ascot component and the "second" valance will be mounted upon the "another" rod, in end-to-end relationship to the "one" valance. The ascot component panel will be extended forwardly over the "another" rod, the hang in overlapped relationship to the proximal marginal portions of both of the valances, and the cascade panels will be extended to overlap the distal marginal portions thereof.

DETAILED DESCRIPTION OF THE ILLUSTRATED EMBODIMENTS

Figure 2:
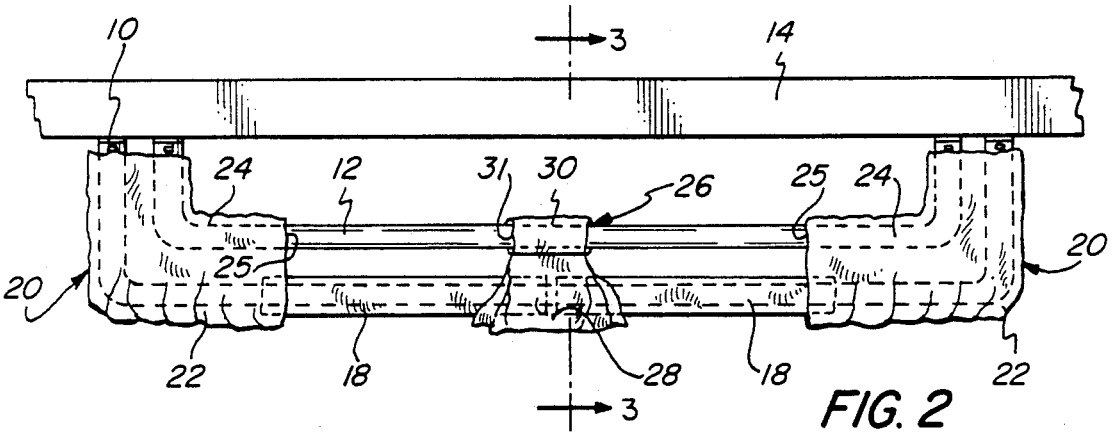
FIG. 2 is a plan view of the system of FIG. 1, drawn to a slightly reduced scale.
Figure 1:
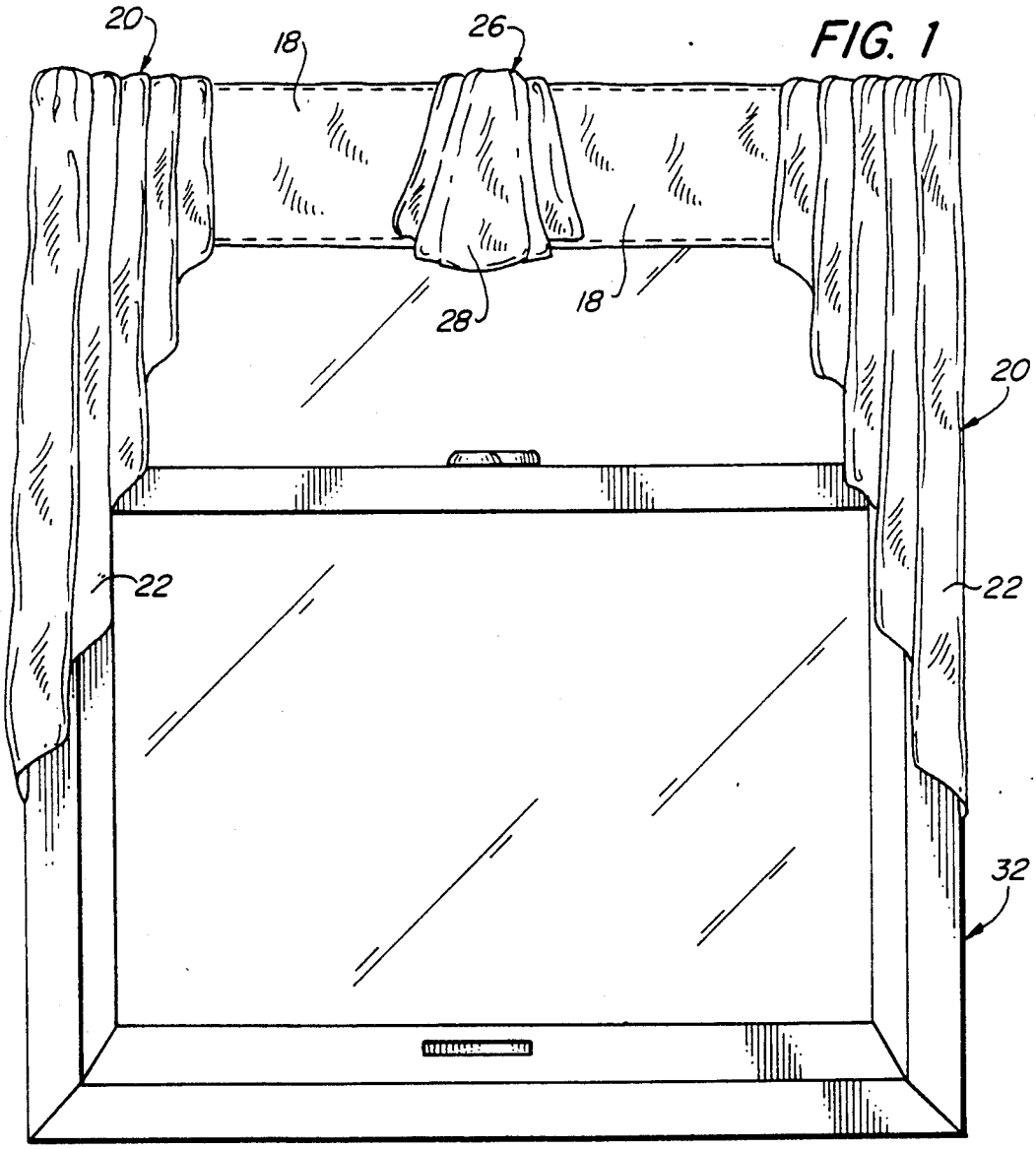
FIG. 1 is a front elevational view, showing a curtain system embodying the present invention installed as a window treatment.
Figure 3:
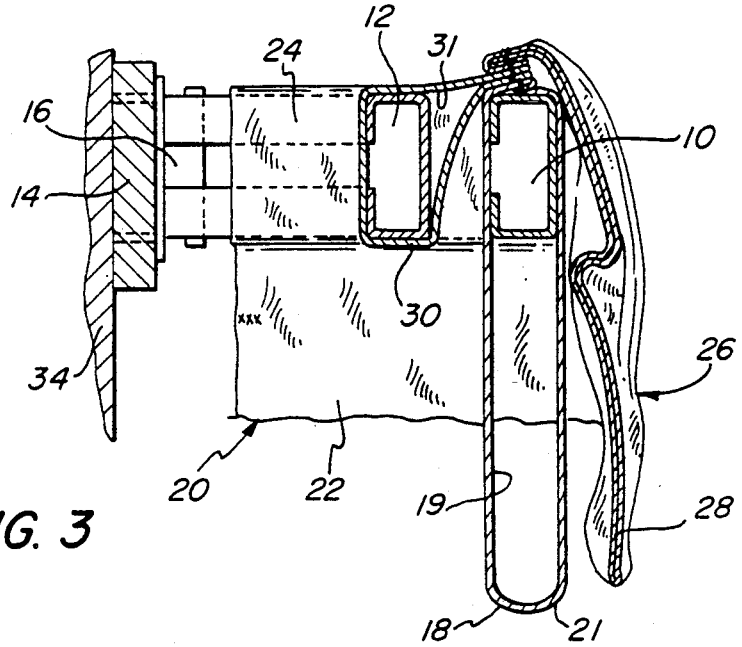
FIG. 3 is a sectional view of the system, taken along line 3—3 of FIG. 2 and drawn to an enlarged scale.
Figure 4:
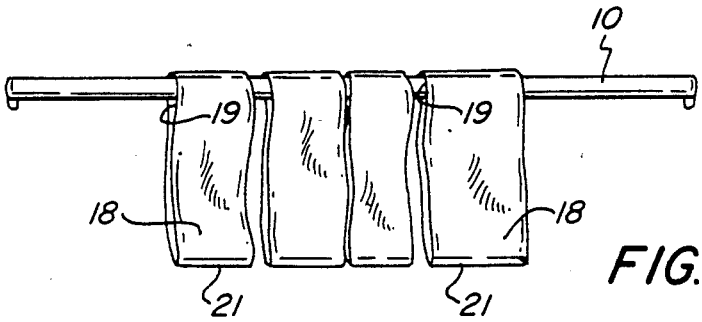
FIG. 4 is a fragmentary front elevational view of the valances and forward rod of the system, drawn to a diminished scale.

Turning now in detail to the appended drawings, therein illustrated is a curtain system embodying the present invention and including forward and rearward parallel curtain rods 10 and 12, respectively, secured to a molding piece 14 so as to dispose them is substantially the same plane; conventional brackets 16 (one of which is shown in FIG. 3) are used for that purpose. A pair of straight tubular valances 18 are suspended side-by-side from the forward rod 10, which extends through the passages 19 that they form; the valances are of uniform width along their lengths, and thus present a rectilinear bottom edge 21 as so mounted.

Figure 5:
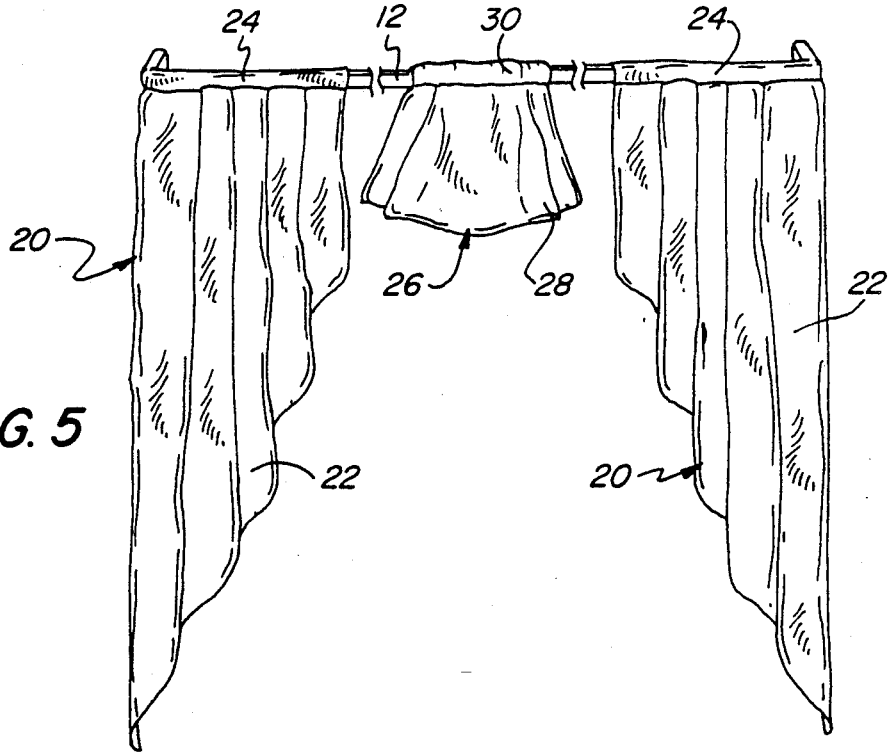
FIG. 5 is a similar view showing the jabots and the ascot mounted upon the rearward rod of the system.

Each jabot, generally designated by the numberal 20, consists of a gently folded or fluted panel 22 and sleeve structure 24, the latter providing a pocket 25 along the top of the jabot through which is received the rearward rod 12. An ascot, generally designated by the numeral 26, is of generally similar construction, consisting of a panel 28, and a sleeve 30 defining a rod-receiving pocket 31. As can be seen in FIG. 5, the jabots 28 are laterally spaced from one another on the rod 12, and the ascot 26 is centrally disposed between them.

For installation, the molding piece 14 is affixed to the wall structure 34 above the window, generally designated by the numeral 32, so as to dispose the two rods 10, 12 in a substantially horizontal plane. The panels 22 of the jabots 20 are extended over the forward rod 10 so as to hang in front of the valances 18, overlapping outer marginal portions at the opposite ends thereof. The panel 28 of the ascot 26 is similarly extended to overlap the proximal marginal portions of the valances, thereby serving to hide the line of separation between adjacent portions of the two valances.

It will be appreciated that the ascot component is optional, and would not of course be utilized when the system comprises only one valance; in that instance, the two jabot would simple overlap the opposite end portions of the valance. On the other hand, it will be understood that more than two valances may be employed for covering a wider expanse of window, in which case the system would include a suitable number of ascot components. The ability to use a plurality of valances in this manner permits them to be made in standardized lengths, and affords considerable flexibility to the system.

The form of the valances may of course vary from that illustrated, albeit that the simple tubular construction shown offers substantial economic, manufacturing and aesthetic advantages. Rather than being so constructed as to present a straight lower edge, the valances may for example be scalloped or otherwise configured, if so desired. Also, the valance tube may be produced from either a single piece of material or from two or more pieces, as may enable an optimal combination of structural and aesthetic features to be achieved, and a forming or stiffening element may be included, if deemed necessary or desirable.

The cascades may also vary widely in style and dimensions. They may for example take the form of the jabots shown in the drawings, or of shorter "falls"; they may be gently folded or fluted, more severely pleated, simply gathered, or indeed of plain construction. Similarly, the ascot component may vary considerably, and may more particularly take the form of either an ascot or a cravat, as are known in the art. In fact, any article of suitable appearance and function may constitute such a component. Finally, it will be appreciated that the elements of the curtain set of the invention will generally be constructed of cloth or supple fabric, but that other materials may be employed, as appropriate.

Thus, it can be seen that the present invention provides a novel, ready-made valance and cascade curtain set, and a novel system including the same, which set and system are highly attractive, facile to install, and relatively inexpensive to manufacture. The curtain set is adapted for sale in packaged condition, for installation by the customer, and lateral expansion is readily accomplished using means that is simple and yet capable of imparting enhanced aesthetics. The invention also provides a novel method for the decorative treatment of a window or the like, using the curtain set herein described.

Having thus described the invention, What is claimed is:

1. A curtain system comprising: a pair of parallel curtain rods, one mounted behind the other and in substantially the same horizontal plane; a pair of cascades mounted in laterally spaced relationship to one another on the rearward rod; and at least one valance mounted on the forward rod in general alignment with the space between said cascades, said valance having lateral marginal portions at opposite ends thereof, and said cascades being draped over said forward rod to hang in front of said valance in overlapped relationship to said marginal portions thereof, each of said cascades including a panel and a laterally extending pocket along the top of said panel through which said rearward rod is received.

2. The system of claim 1 wherein said valance is of straight configuration, presenting, as so mounted, substantially parallel upper and lower rectilinear edges.

3. The system of claim 1 wherein said valance is fabricatied from a pliant material and is of tubular form, defining a passage through which said forward rod is received.

4. The system of claim 1 additionally including at least a second said valance mounted on said forward rod, and at least one ascot component comprised of a panel and a pocket extending laterally along the top thereof, said valances being disposed in end-to-end relationship with the adjacent marginal portions thereof proximate one another, and said ascot component being mounted on said rearward rod in the space between said cascades and centrally aligned behind said valances, and being draped over said forward rod to hang in overlapped relationship to said proximate marginal portions of both of said valances.

5. A ready-made cascade and valance curtain set, comprising at least one valance and a pair of cascades adapted to be hung on two parallel rods, each of said cascades including a panel and a pocket extending laterally along the top of said panel through which one of the rods may be received, and said valance being of tubular form and defining a passage for receipt therethrough of a curtain rod, and having lateral marginal portions at opposite ends thereof.

6. The curtain set of claim 5 wherein said valance is of straight form providing, in flat condition, substantially parallel upper and lower rectilinear edges.

7. The curtain set of claim 6 additionally including at least a second said valance, and at least one ascot component comprised of a panel and a pocket extending laterally along the top thereof, the distance between said upper and lower edges being the same in both of said valances, and each of said valances having at least one rectilinear lateral edge, said panel of said ascot component having a top-to-bottom length dimension that is at least somewhat in excess of said distance between said upper and lower edges of said valances.

8. A method for the decoration of a window or the like, comprising the steps:

(a) providing a ready-made cascade and valance curtain set, comprising at least one valance and a pair of cascades adapted to be hung on two parallel rods, each of said cascades including a panel and a pocket extending laterally along the top of said panel through which one of the rods may be received, and said valance having lateral marginal portions at opposite ends thereof;

(b) providing one rod and inserting it through said pockets of said cascades so as to dispose them in laterally spaced relationship to one another thereon;

(c) providing another rod and mounting said valance thereon;

(d) providing another rods to supporting structure with said one rod behind said another rod and substantially in the same horizontal plane; and (e) extending said cascade panels forwardly over said another rod to hang in front of said valance in overlapped relationship to said marginal portions thereof.

9. The method of claim 8 wherein said curtain set additionally includes at least a second said valance, and at least one ascot component comprised of a panel and a pocket extending laterally along the top thereof; wherein, in said step (b), said one rod is also inserted through said pocket of said ascot component; wherein, in said step (c), said second valance is mounted on said another rod in end-to-end relationship to said one valance, with the adjacent marginal portions thereof proximate one another; and wherein, in said step (e), said ascot component panel is extended forwardly over said another rod to hang in overlapped relationship to said proximate marginal portions of both of said valances, said cascade panels being extended to hang in overlapped relationship to distal marginal portions thereof.

* * * * *

UNITED STATES PATENT AND TRADEMARK OFFICE

CERTIFICATE OF CORRECTION

PATENT NO. : 5,092,384

DATED : March 3, 1992

INVENTOR(S) : Madlyn Easley

It is certified that error appears in the above-identified patent and that said Letters Patent is hereby corrected as shown below:

Claim 8, column 5, line 5, delete "providing another" and substitute therefor --mounting said--.

Signed and Sealed this

Fourth Day of May, 1993

*Attest:*

Michael K. Kirk

MICHAEL K. KIRK

*Attesting Officer*

*Acting Commissioner of Patents and Trademarks*